US008038519B1

(12) United States Patent
Luciano, Jr.

(10) Patent No.: US 8,038,519 B1
(45) Date of Patent: Oct. 18, 2011

(54) RAFFLE GAME SYSTEM AND METHOD

(75) Inventor: Robert A. Luciano, Jr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 506 days.

(21) Appl. No.: 10/630,104

(22) Filed: Jul. 29, 2003

Related U.S. Application Data

(60) Provisional application No. 60/400,022, filed on Jul. 30, 2002.

(51) Int. Cl.
*A63F 9/24* (2006.01)

(52) U.S. Cl. ..... 463/16; 463/17; 463/18; 463/19; 463/20; 463/22; 463/25

(58) Field of Classification Search ..... 463/16–20, 463/22, 25
See application file for complete search history.

(56) References Cited

U.S. PATENT DOCUMENTS

| | | | | | |
|---|---|---|---|---|---|
| 4,582,324 | A * | 4/1986 | Koza et al. | ..... | 463/16 |
| 4,652,998 | A * | 3/1987 | Koza et al. | ..... | 463/26 |
| 5,007,641 | A * | 4/1991 | Seidman | ..... | 463/17 |
| 5,324,035 | A * | 6/1994 | Morris et al. | ..... | 463/42 |
| 5,505,449 | A * | 4/1996 | Eberhardt et al. | ..... | 463/29 |
| 5,569,082 | A * | 10/1996 | Kaye | ..... | 463/17 |
| 5,709,603 | A * | 1/1998 | Kaye | ..... | 463/17 |
| 5,800,269 | A * | 9/1998 | Holch et al. | ..... | 463/42 |
| 5,810,664 | A * | 9/1998 | Clapper, Jr. | ..... | 463/17 |
| 5,855,369 | A * | 1/1999 | Lieberman | ..... | 273/139 |
| 6,146,272 | A * | 11/2000 | Walker et al. | ..... | 463/17 |
| 6,168,521 | B1 * | 1/2001 | Luciano et al. | ..... | 463/17 |
| 6,183,361 | B1 * | 2/2001 | Cummings et al. | ..... | 463/18 |
| 6,241,606 | B1 * | 6/2001 | Riendeau et al. | ..... | 463/17 |
| 6,368,218 | B2 * | 4/2002 | Angell, Jr. | ..... | 463/40 |
| 6,592,454 | B2 * | 7/2003 | Libby et al. | ..... | 463/6 |
| 6,648,755 | B1 * | 11/2003 | Luciano, Jr. et al. | ..... | 463/17 |
| 6,783,456 | B2 * | 8/2004 | White | ..... | 463/18 |
| 6,857,959 | B1 * | 2/2005 | Nguyen | ..... | 463/25 |
| 6,905,411 | B2 * | 6/2005 | Nguyen et al. | ..... | 463/25 |
| 6,938,895 | B2 * | 9/2005 | Adams | ..... | 273/139 |
| 6,958,014 | B1 * | 10/2005 | Luciano, Jr. et al. | ..... | 463/17 |
| 7,169,041 | B2 * | 1/2007 | Tessmer et al. | ..... | 463/16 |
| 2002/0187825 | A1 * | 12/2002 | Tracy et al. | ..... | 463/17 |
| 2003/0114211 | A1 * | 6/2003 | White | ..... | 463/17 |

* cited by examiner

*Primary Examiner* — Omkar Deodhar
(74) *Attorney, Agent, or Firm* — David N. Caracappa; Russ Marsden

(57) ABSTRACT

An automated raffle game and method making use of prize pools, the prize pools having elements, the elements representing one of: winning prizes; or, both winning prizes and no-win (0 value) prizes. Raffle tickets are associated with a prize pool. Upon closure of the game, either by a time-out or by number of tickets sold, a number of elements are taken from the pool. The number of elements taken from the pool is directly related to the number of tickets associated with the pool and further depends on which type of pool is being used (one having only win-elements or both win and 0-value elements). The results are sent to the player terminal, where a player may simply take a winning voucher or ticket, or, may chose to view an entertainment display.

10 Claims, 6 Drawing Sheets

Player Terminal

Gaming Style Machine
Player Terminal

Raffle System With Player Terminals And Central Server

Raffle Systems In A Casino Or Bingo Hall Environment

Example Raffle Game
Award And Distribution Method

Example Raffle Game Play

RAFFLE GAME SYSTEM AND METHOD

RELATED APPLICATIONS

This application claims the benefit of provisional application 60/400,022 filed on 30 Jul. 2002.

BACKGROUND OF THE INVENTION

1. Field of the Invention

This invention pertains generally to raffle games. More particularly, the invention is a fully automated raffle game and system using fixed prize pools and providing entertainment displays.

2. The Prior Art

Traditional raffle games, using manual raffle cards, are known. In a manual raffle, players purchase tickets that allow them to be in contest for a prize, and then watch for a manual or automated draw corresponding to the game for which they bought tickets. Players then turn in winning tickets at a cashier's station or redemption station to receive their prize. Prior art raffle play is limited to the single game (raffle) for which the tickets were purchased, and takes a long time to complete.

There are more automated raffle-style games, which are characterized by many state lottery systems. Tickets are purchased by a player at a sales counter, after which the player watches winning ticket numbers being drawn and/or displayed on a video screen, or, simply waits until they know the winning ticket has been drawn after which they present their tickets to an automated ticket reader, which lets them know if the ticket is a winner or not.

The above systems leave much to be desired. The turn-around is slow per game, the notification and redemption is slow, players have to keep track of paper tickets, and the ability to play with multiple games using different betting amounts is severely limited.

BRIEF DESCRIPTION OF THE INVENTION

The present invention is a raffle-style game that provides for faster individual games, more betting options (a large range of betting amounts), and more entertainment value than has previously been available.

This is accomplished through a new and unique system and method. The system is based on a plurality of fixed-pools or fixed-pool set of winning results, which are kept on a central server. Each player terminal is operatively connected via a network (the specifies of the network being determined by such considerations as the physical distance between the player terminal and the central server) to a central server. A player can interactively purchase tickets into any raffle game currently available on the central server. Game winners are drawn from the pool of purchased tickets at pre-determined intervals. The prize won by the game winners is determined by a random drawing from the remaining entries in the fixed pool corresponding to the chosen game. The central server then communicates to each player terminal from which a ticket was purchased, telling each player terminal how much was won on each ticket (for losing tickets, this is simply "0"); or, what prize was won. The player may then chose how to display their results. They can print tickets or have the player terminal use an entertainment display to show an equivalent result (commonly in the form of a reel-type slot machine display). The entertainment display will use the predetermined outcome from the raffle drawing to display game symbols on the reels that, when used with a paytable or symbol-table visible to a player, correspond to either a prize that has been won, a certificate of a certain value or that corresponds to a set of prizes that have a predetermined prize value range (i.e., a retail value of $500 to $600) from which the play may make a selection, or, with the cash amount won. Although slot type games are one preferred embodiment, other games of chance (dice, poker, other card games) or animated sequences (i.e., a sports sequence such as animated football teams where a player makes a touchdown, a horse race, a gymnast doing a move with or without falling, etc.), may be used to display the determined results in an entertaining fashion.

One preferred embodiment will have the system of the present invention running in a casino or Amerindian bingo-style establishment. The present invention can readily be implemented in either a single property or over several physical properties. If the system is used over a plurality of properties, the raffle server may or may not be the same corporate entity that owns or operates one or more of the multiple physical properties. This enables considerable freedom in configuration of the overall system, as well as a "cost sharing" approach for the system itself. Multiple small bingo halls, casinos, or Amerindian gambling establishments could share the cost of a central server system and, by networking their player terminal to the central system in a physical remote site, be fully enabled to play a full spectrum of raffle style games. This additionally allows larger winnings, more frequent individual game turn-around time, and centralized bookkeeping.

BRIEF DESCRIPTION OF THE DRAWINGS

The present invention will be more fully understood by reference to the following drawings, which are for illustrative purposes.

FURTHER DESCRIPTION OF EMBODIMENTS

Persons of ordinary skill in the art will realize that the following description of the present invention is illustrative only and not in any way limiting. Other embodiments of the invention will readily suggest themselves to such skilled persons having the benefit of the present disclosure.

The raffle system and method of the present invention directly addresses the shortcomings of the prior art. It provides for faster turn-around time per game, enables players to be playing a plurality of games and a multiplicity of wagering amounts in a dynamic manner, enables instant ticket redemption (if so desired by a casino or bingo-hall, or if allowed in the jurisdiction where the player terminal are located), and provides for game results to be shown in an entertainment mode.

Figure 1:
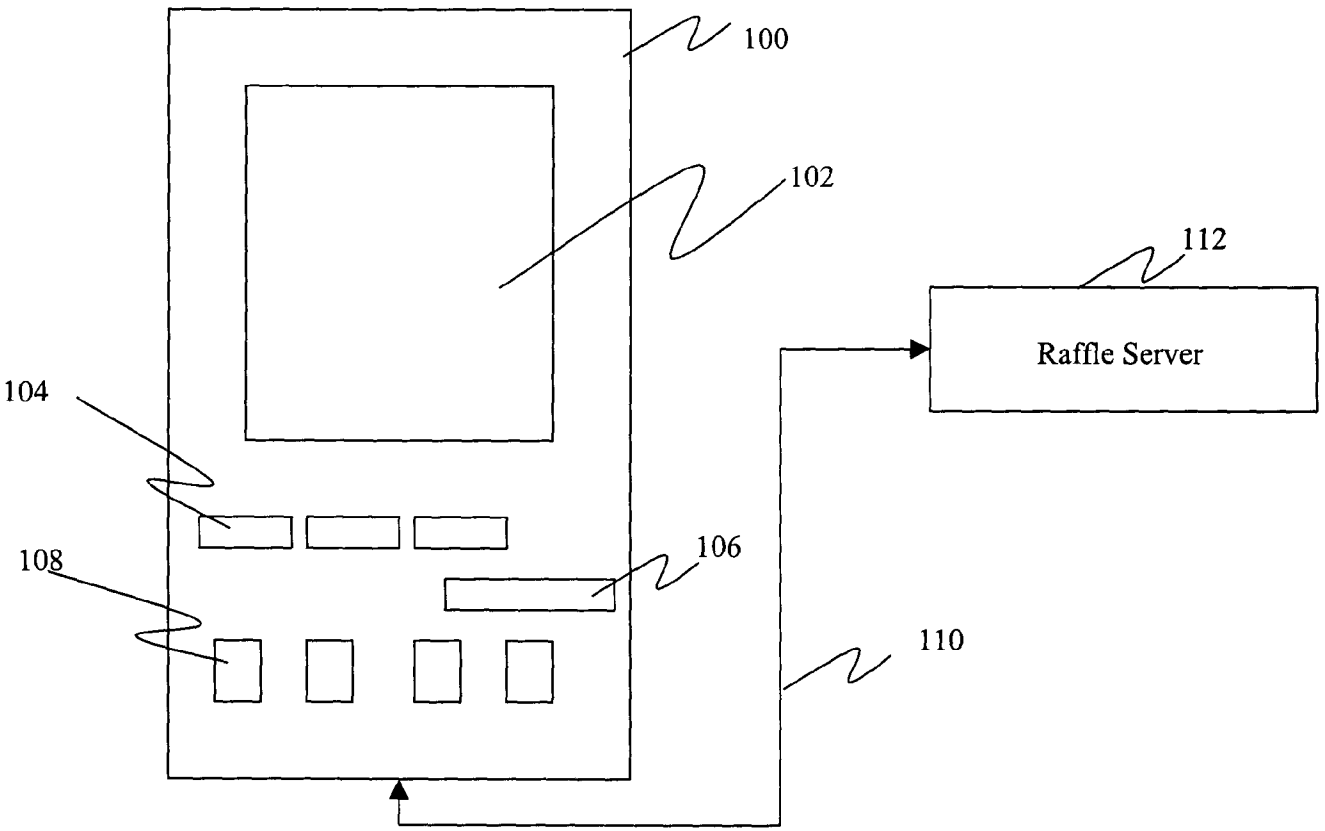
FIG. 1 is a block diagram of a player terminal according to the present invention.

FIG. 1 illustrates a general player's terminal usable with the present invention. There will be an enclosure 100 having a video or other electronic display 102 viewable by a player. There will be one or more input ports or slots, shown generally as slots 104. These slots may be configured and equipped to receive bills, player ID cards, vouchers, low power RF or IR signals from a handheld device, smart cards, memory cards, and similar inputs. In all cases, the input will be used in accordance with its type to generate game play credits (i.e., in the case of bills, vouchers, or smart cards, directly; in the case of player IDs in the form of an EFT [electronic funds transfer] or ECT [electronic credit transfer] from a central server). There will typically be an output slot 106 for a printer to enable the printing and dispensing vouchers or tickets. Also shown are a plurality of player input buttons 108. The exact number and function of the player input buttons will be determined by the particular implementation of the player terminals requested by specific casinos or similar establishments. It is fully contemplated that some player terminals will make use of touch screens that could supplant the use of mechanical buttons altogether. A further implementation will use a tablet-style player terminal with a wireless connection to the central server. Any and all such variants are fully contemplated by the present invention.

Each player terminal must have an operable connection 110 to a central server 112. This will typically be a serial line or ethernet connection within a single site, but readily includes any type of LAN/WAN configuration required for each particular installation, including physically remote sites using a common server.

Each player terminal will have internal portions (not illustrated) that are typical for this type of gaming or entertainment machine. That includes electronic interfaces to each video or mechanical human interface device, electronic interfaces to a printer (if a printer is used), a network interface, at least one programmable logic unit (or CPU) and associated support chips including but not limited to static and dynamic memory, and one or more interface boards and associated logic operably connecting each externally visible function or port to a CPU.

Figure 2:
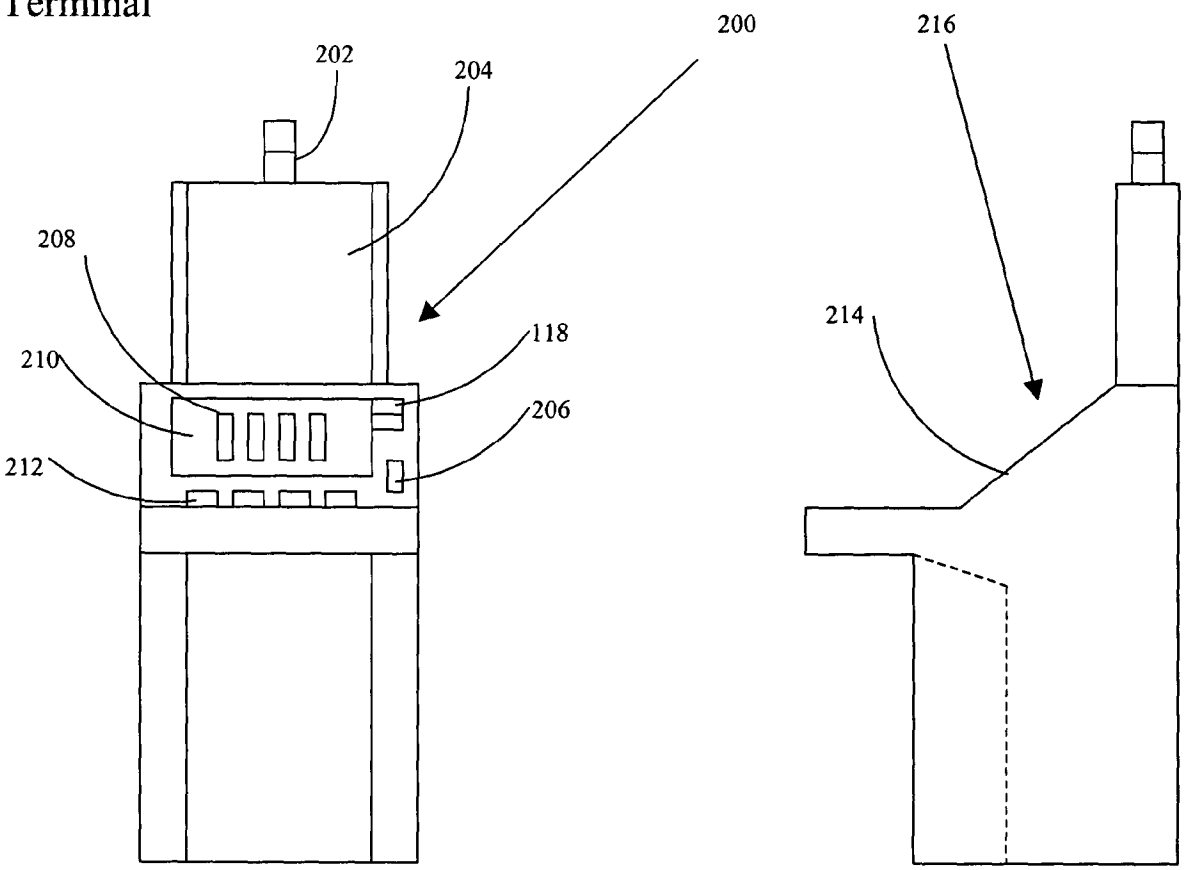
FIG. 2 is a block diagram illustrating a casino-style player terminal according to the present invention.

FIG. 2 illustrates one preferred embodiment of the generic player terminal from FIG. 1. It is intended to mimic a traditional slant top casino gaming machine to enable players to feel like they are at a Nevada-style casino. Player terminals for use in a system according to the present invention are fully expected to be based on the same slant top game boxes as those used in traditional casinos. The internal programming will be different, as will some player interface buttons, but will be intended to provide real casino look and feel within the confines of a raffle system.

FIG. 2 illustrates a front view 200 and a side view 216. Candle 202 lights when there is a machine fault (including a machine running out of tokens or coins to pay a cash-out), or a monetary prize over a certain amount to be awarded. Area 204 is typically art for the game, and is usually passive. There is a monetary input slot 206, which is typically a bill acceptor. Monetary input slot 206 may be, or may include, a coin acceptor. Coin acceptors may be used in certain lower-denomination raffle game installations ("penny", "nickel", "quarter" betting). Area 210 will typically comprises a video screen having the appearance of a glass cover having opaque art, with windows 208 showing individual slots or reels. This would be used during entertainment mode. Prior to entering entertainment mode, area 210 will be used to display information about on-going raffle games and betting options (ticket purchase options). There are a set of player input devices, typically buttons, shown at 114. Side view 116 shows the slanted portion of the machine (thus the general name "slant top"), which has the game viewing area 214. On some machines there will also be either one or two small numerical displays, shown as 118. One display shows the player the number of game credits they have, the other (if present) may show some kind of special raffle game announcement, or may simply have scrolling advertising for the casino. These displays may be found almost anywhere on a gaming machine that is visible to a player.

Figure 3:
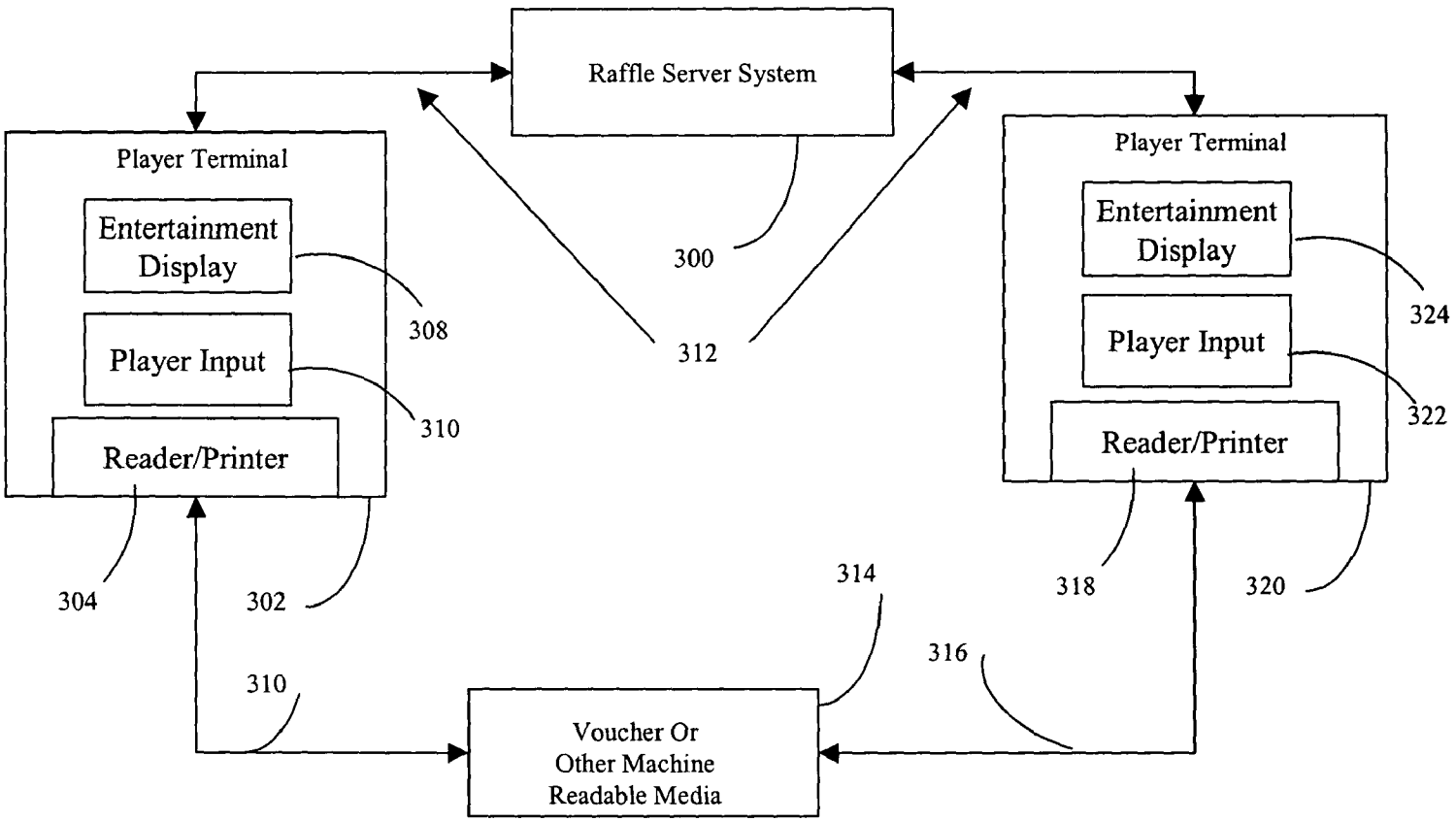
FIG. 3 is a functional block diagram of a raffle system according to the present invention.

FIG. 3 illustrates a raffle system in accordance with the present invention. Player terminal or game device 302 and 320 have therein the typical components found in a gaming or entertainment machines, as described above for FIG. 1, and further including all embodiments such as wireless tablet-style gaming terminals. They will be controlled by programs suitable to implement the player terminal functions of the present invention. Two player terminals are shown for illustrative purposes; any number may be used. Further shown are reader/printers 304 and 318. Reader/printers 304 and 318 are configured to accept as input machine readable indicia (such as bar code on a voucher) or media (such as a magnetic strip on a card). Further, the reader/printers may also comprise IR or RF ports, or other interfaces to hand-held devices used by players. Reference to printers is further understood to be a compatible form with the readers in use with any particular installation. For example, if the reader is a voucher reader, then the printer is a voucher printer. If the reader is an RF port receiving signals from a hand-held device used by a player, then the "printer" (output device) includes the concept of the transmission of RF signals in a manner receivable by the same hand-held device. Further included in player terminals 302 and 320 are player input devices 306 and 322.

Voucher 314 is one method a player may use to transfer game credits and/or game information (typically ticket purchase or winning ticket information) from one player terminal to another. This enables a player to stop playing at a terminal by requesting a voucher that has the player's current game play state thereon. This will typically be done using a unique ID (which may be comprised of the issuing machine ID coupled with date/time information to the granularity required for uniqueness, or other unique numerical ID) which will then be used to retrieve game information when the voucher is inserted into another player terminal. Alternatively, the voucher may have all outstanding ticket information on it, so that when a player inserts the voucher into another player terminal at a later time or date, the central server sends the results of the finished games corresponding to the tickets on the voucher to the player terminal now in use.

Requesting a voucher stops the player terminal currently being used from displaying and issuing credits (or other winnings) based on the results of the tickets outstanding at the time the voucher is issued. This enables players to stop playing for a while, even if they have outstanding games in progress. This significantly enhances usability to the players.

Also shown are network connections 312 which enable operable coupling of the player terminals to Raffle System Server 300. The present invention requires the use of at least one server 300, but is not limited to one. Depending on the specifics of each implementation, there may be a plurality of servers on a site or distributed over several sites. As discussed above, a player may request a voucher which (to a player) stops game play on that terminal. Either the player terminal generates a unique transaction ID or the central server may generate it (which device generates the unique transaction ID will be implementation dependent). In either case, the ticket data and unique transaction ID are stored in the database (Oracle or similar database package) on the Raffle server. The voucher may or may not have all outstanding ticket data printed thereon—this will depend on the specifics of each implementation. The voucher will always have the unique transaction ID on it, preferably in encrypted form (this will require an encryption/decryption program on either each player terminal or on the Raffle server—whoever generates unique IDs will need to have the capability to encrypt/decrypt). When a player inserts the voucher on a different player terminal, the Raffle server will (i) verify the tickets to be displayed on the player terminal if the ticket info was on the voucher, or (ii) retrieve any ticket info associated with the unique transaction ID on the voucher from its database.

The database on Raffle server 300 is also usable with player IDs, both in traditional form (a player ID card) and with APIDs (anonymous player IDs). The data about tickets bought, when, and on what machine will be kept in a manner associated with the player ID. The player ID will then be used to retrieve the information. This allows a player to keep one voucher or one player's card, and go from player terminal to player terminal as the wish, even with games in play.

Figure 4:
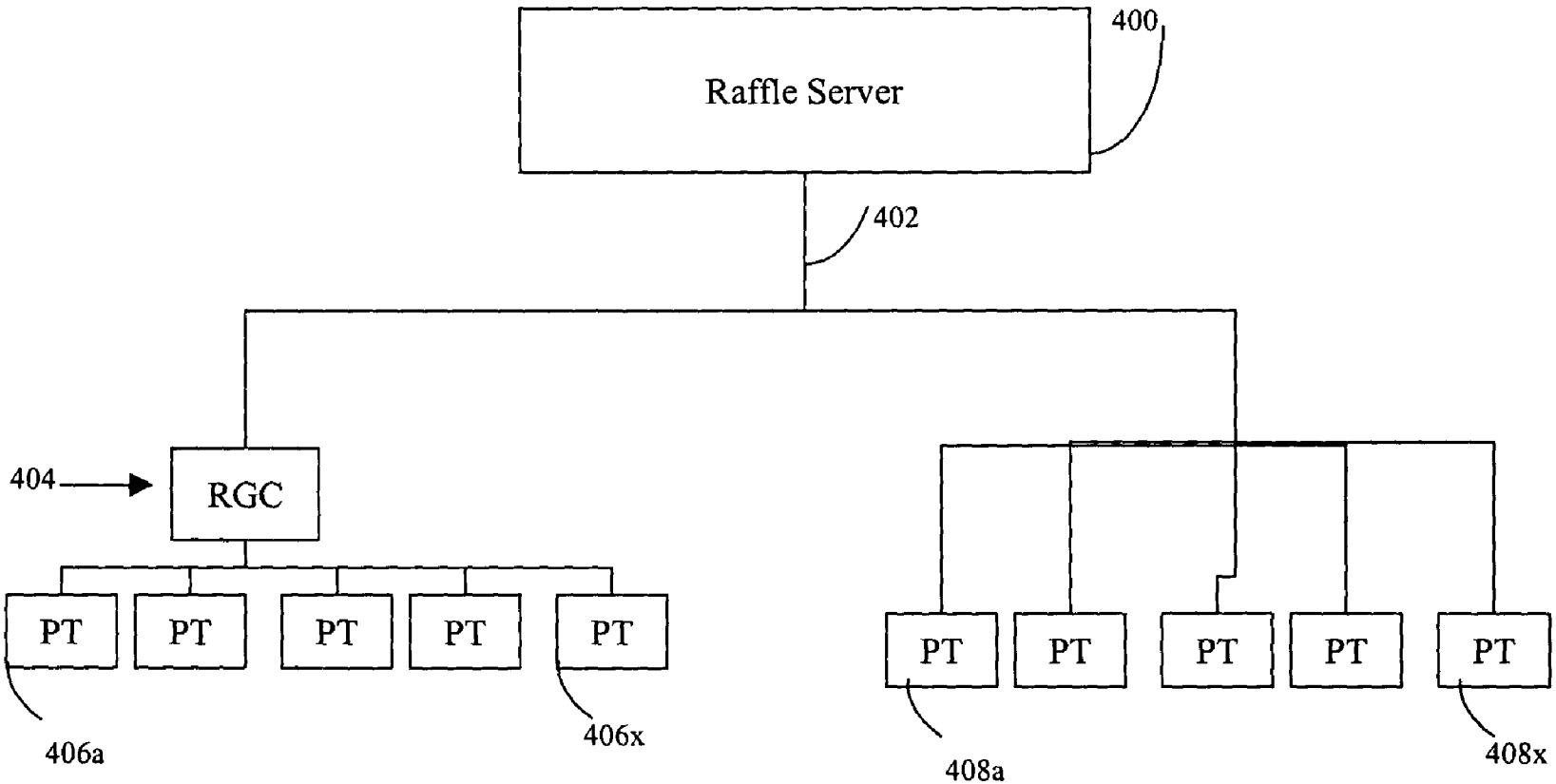
FIG. 4 is a functional block diagram of a raffle system in a casino-style environment according to the present invention.

FIG. 4 shows a raffle game system usable in a casino or bingo environment. Shown is Raffle Server 400 connected via network 402 to a set of player terminals 408*a* to 408*x*. These would operate as described above. The present invention is also completely compatible with traditional casino gaming infrastructures, shown with Raffle Server 400 connected to remote game controller (RGC) 404. RGC 404 is then connected to player terminals 406*a* to 406*x*. Typically network 402 will be a LAN using ethernet, while the connections from RGC 404 to the player terminals will be based on a serial line protocol.

When there is an RGC between the player terminals and the raffle server, there are several general implementations that may be used. One is to program the RGC to pass through any communications between player terminals and the raffle server, with the RGC acting as a protocol converter. The player terminals and raffle server will work as if the RGC is transparent, as far as raffle games go (there may be other games on the player terminals run by the RGC concurrently with the raffle games).

Another implementation would use the RGC as an additional raffle server, which would run raffle games on the player terminals connected to it. The main server would generate the fixed pools, and depending on the capabilities of the RGC, could be used as a source of random numbers used for drawing winning tickets and drawing the winning amount (or item) from the fixed pool. The RGCs would then handle matching the winning tickets and winning prize and the related logistics to each player terminal. Alternatively, there may be a plurality of RGCs that each derive winnings pools from a central server, and then run local raffle games until the pools are exhausted. New pools will then be provided by the central server.

Figure 5:
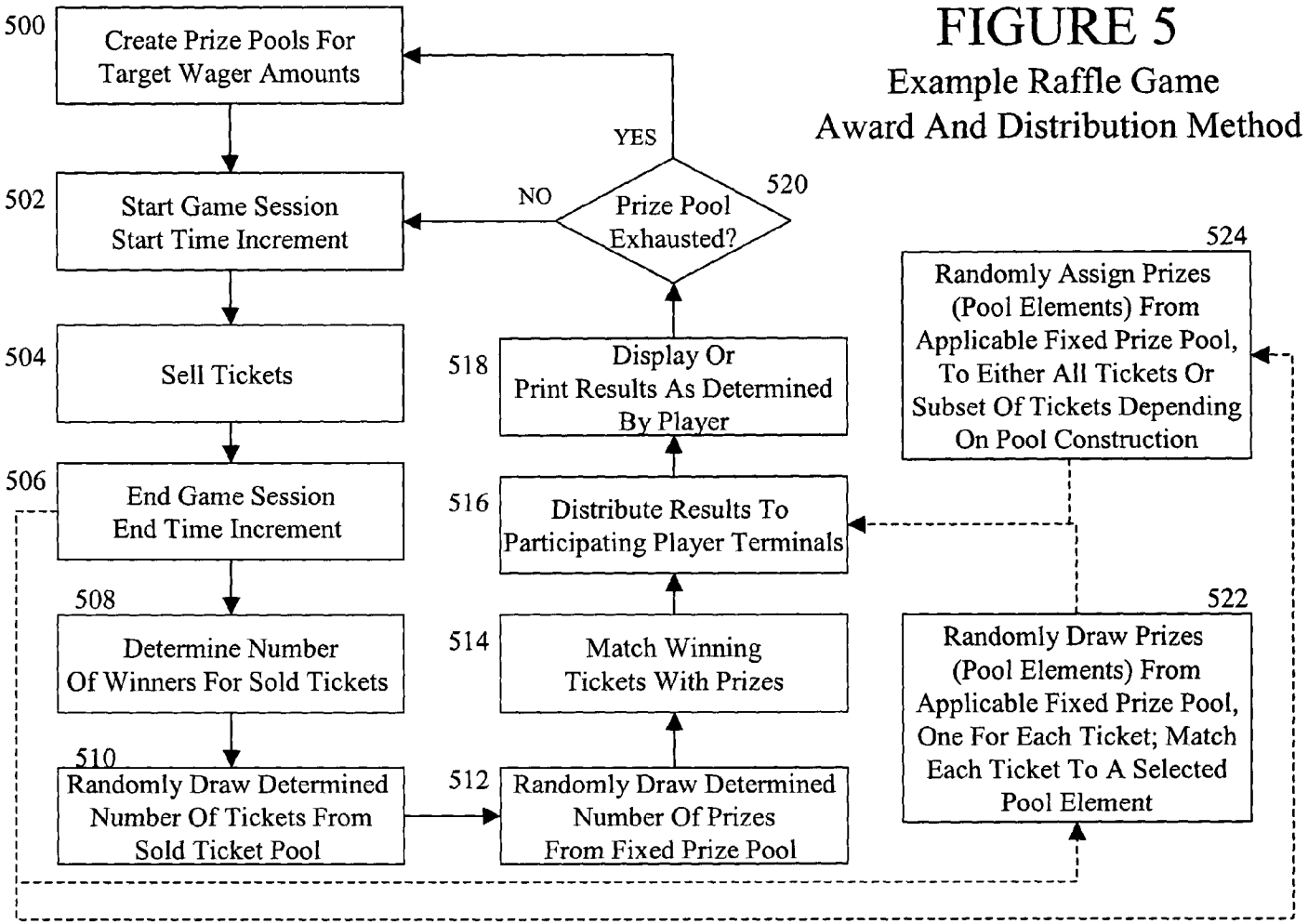
FIG. 5 is a flow diagram of an exemplar use of the raffle game and system of the present invention.

FIG. 5 shows an example of a raffle game award and distribution method in accordance with the present invention. Starting at box 500, a raffle server creates a prize pool. The prize pool is a set of indicators, where each indicator or key (into a database) is associated with a prize. A prize is anything having non-zero monetary value that the organization running the raffle game wants to give out as rewards. Prizes include but are not limited to additional game credits, monetary amounts, cars, collectible items, bric-a-brac, logo items, jewelry, vacation trips, or any other prize. Any and all prizes are contemplated as usable with the present invention.

Further included into the creation of a prize pool is the target wager amount, and the win frequency (i.e., a higher win frequency will typically be accompanied with smaller individual prize values in the prize pool). Note that there are no "loser" prizes in the prize pool. Non-winning tickets are handled outside of the prize pool, and are described below. To run the games there must be at least one prize pool; however, a typical installation will be running many games, each using at least one prize pool generated for the that game, simultaneously. A preferred embodiment will use one prize pool for each waging amount within a game. For example penny, nickel, dime, quarter, $1.00, $5.00, etc., would each have a corresponding prize pool. This enables prizes having values corresponding to the amounts bet, coupled with control of the win frequency, to allow the overall payout percentage to be controlled and tailored for each level of wagering.

The plurality of fixed (pre-drawn) prize pools is a key element in enabling fast, responsive, configurable, and yet controlled game play where there is a requirement that prizes come from a predetermined pool, in this case raffle-style games drawing from known pools. This makes the game a raffle or raffle-style game, and further enables the game to be run in a non-banked manner by creating fixed holds for operators. Non-banked play is enabled because the total value of the pool is known, and the total value of the tickets that will be purchased before the pool is exhausted is known, so the overall hold or take percentage can be a fixed amount per raffle, if desired. Box 500 is left and the actions corresponding to box 502 started.

The actions corresponding to box 502 are those associated with starting an individual game session or game play. For each pool, there will be a repeating series of individual game sessions until the prize pool is exhausted. Each game session is based on a fixed time period (bounded by a start and stop time, which may be implemented in any functional way including counters, timers, system clocks, etc.) and the tickets sold during that time period, from which potential winners are determined. Box 502 represents the start of an individual game, which includes the starting of the predetermined time increment. The time value of the increments will be settable by the establishment using the game and system of the present invention. In one preferred embodiment, the time increment for each game session will be in seconds, creating a more "instantaneous" feel to players in terms of getting results for their wagers. However, it is entirely within the scope of the present invention to have individual game sessions last any amount of time an establishment using the disclosed system wishes. Further, it is expected that, depending on the wagering amount and the valuation of the prizes in the prize pool, there will be some games run with sessions lasting a few seconds, while simultaneously running games whose individual sessions last hours, days or even weeks. For unusual prize pools (houses, upscale cars, or other very expensive items) it may be reasonable to extend sessions even further. The present invention can easily accommodate games having sessions of any duration. The determination of how long each session in a game will last will typically be a combination of marketing judgment and jurisdictional rules. The present invention fully contemplates all such time variations in game sessions. Box 502 is left and the actions corresponding to box 504 started.

The actions corresponding to box 504 are the selling of tickets, which will be used to determine a winner (if any). In the present invention, "selling tickets" may be done in several general ways. Players are using a player terminal, so the most common method of selling tickets will be a player placing a bet or wager. A bet or wager will be placed on a specific game for a specific amount. This is the electronic equivalent of a ticket sale. Each game will ordinarily have a set of prize pools associated with it (must have at least one), with different prize pools corresponding to different wager amounts (so payout ratios can be maintained). Thus, making a wager at the player terminal corresponds to the action of electronically purchasing a ticket, where that ticket is associated with a particular game and a particular wager amount and a particular session. Put differently, this associates an electronic ticket with a single game session and a single prize pool. Any activity by a player that results in an electronic association between a play request (wager, ticket sale), however paid for (i.e., in addition to traditional cash or vouchers, a play request could be funded by a promotional award of some kind, as a result of a subscription to a service, by a third party who is gaining advertising advantage, etc.) is fully contemplated by the present disclosure.

In some jurisdictions wagers (electronic ticket sales) may be made to anyone once inside a casino, bingo parlor, or other gaming establishment. If the player wins, winnings can be given out in the manner typical of these establishments: coin out from the machine, vouchers, cash-out tickets, hand pay by attendants, and the like. However, some jurisdictions require that each ticket purchase be to a known person. In such cases, the player terminals of the current invention will be equipped with some kind of player identification system. The most common will be player tracking or player ID cards. These cards look like credit cards, having a magnetic strip on one side. The player terminal will have a magnetic strip reader, which will be required to be inserted before a player can make a bet (buy a ticket). Any ticket sales will be logged in a backend database, associating the wagering (electronic ticket sales) with the player data that the player provided to the establishment in order to get a player's card. Although it is expected that magnetic strip cards will be the most common form of player identification, any form of authentication is fully contemplated by the present invention. This includes but is not limited to using a PIN (with a keypad on the player terminal), a biometric ID (one example being the use of a fingerprint reader on the player terminal, typically associated with a PIN as well), or a voucher ID (temporary paper ID).

The actions corresponding to box 506 are now started, which correspond to those needed to end a game session. First, the mechanism to keep track of the predetermined time increment triggers the end of the session. As soon as the session is determined to be over, the tickets that have been sold during the just ended session now comprise the group of sold tickets from which a winner may be chosen. Any wager (ticket sale) coming in from a player terminal after this session is over will be assigned to the next session (the next time increment), where a session may encompass play from a next pool if the current pool is exhausted or may encompass play from several open pools using a round-robin prize selection algorithm, if an open pool is below a certain number of remaining prizes (prevents players from being momentarily interrupted). Box 506 is left using the solid line and the actions associated with box 508 started. Dotted line connections to box 522 and box 524 are also shown and are explained further below (the dotted lines correspond to alternative prize pool construction and ticket selling methods). Any suitable prize pool construction derived by a mathematician using the invention as described in the present disclosure is usable with the present invention.

The actions associated with box 508 are to determine, using the number of tickets sold during the just-ended session, how many are to be declared as winners. That number will be based on the overall win frequency the casino or other gambling establishment wants to have. Using the predefined overall win frequency, a certain number of the tickets that have been sold for this game session will be determined to be winners (i.e., if the win frequency is 50% and 26 tickets have been sold, there will be 13 winning tickets). Once the number of winning tickets is determined, that number of prizes is drawn from the applicable prize pool and assigned to the winning tickets. Note that the correlation between prizes and sold tickets should be random, which can be accomplished in a number of ways. For example, the 13 prizes to be selected from the pool can be drawn randomly and assigned to randomly selected 13 winning tickets. If there are an unusually small number of ticket sales for a particular game session, it may be the case that this particular sold ticket pool will be determined (calculated, using the win frequency) to have no winners. In such cases the win frequency will be numerically manifest over a series of sessions (averaged). Thus, it will always be the case that there will be a number calculated which will be equal to or greater than 0 and smaller than or equal to the number of tickets in the sold ticket pool for each session, where the calculation is based on the win frequency. This will be called the determined number of winners for this session, or the determined number. Box 508 is left and box 510 entered.

The actions corresponding to box 510 are those needed to randomly draw the determined number (from box 508) of tickets from the sold ticket pool. This is done using a random number generator to insure that the draw is a random event (in one preferred embodiment each ticket drawn will be a separate random event). These are the winning tickets. Note it is possible for this number to be 0, which means no tickets will be selected and which makes this step very, very fast. Box 510 is left and box 512 is entered.

The actions corresponding to box 512 are those needed to randomly draw the determined number (from box 508) of prizes from the prize pool. This is done using a random number generator to insure that the draw is a random event (in one preferred embodiment each prize drawn will be a separate random event). These are the prizes to be associated with the winning tickets. As with box 510, this includes the possibility of the determined number being 0, which corresponds to drawing no prizes from the prize pool. Box 512 is left and box 514 is entered.

The actions corresponding to box 514 are those needed to match the drawn tickets with the drawn prizes. This may be done in any fashion. One preferred embodiment will match the first drawn ticket with the first drawn prize, the second drawn ticket with the second drawn prize, and so on. Another preferred embodiment will randomly match the two randomly selected tickets and prizes. Other methods of pairing tickets with prizes will readily come to mind of a person having ordinary skill in this art and having the benefit of the present disclosure. As with boxes 510 and 512, if the determined number is 0 then there will be no matching, making this a really fast part of the process! Box 514 is left and box 516 is entered.

Returning to box 506, an alternative method for constructing and using prize pools is shown by following the dotted line to box 522. In this construction, the prize pool includes null elements (elements having no value). The pool is initially constructed so that when the pool is exhausted, the predetermined payout rate and prize frequency is statistically as desired, determined theoretically or over some number of pools at the same wagering level. Note that typically there will be a plurality of sets of pools, with a set of active pools (there will always be a minimum of one active pool) for each wagering level. Unlike the previous method, due to random matching of tickets (wagers) and pool elements, there may be individual game sessions that result in all players having a winning event or no players having a winning event. The desired payout and win frequency is a statistical measure rather being fixed per session or per play.

Box 522 corresponds to using an active pool by drawing the same number of pool elements as outstanding tickets (number of wagers applicable to this pool). The elements drawn from the pool and the outstanding tickets are matched up in a random fashion. There may be any number of ways of accomplishing this random association between tickets (individual wagers) and pool elements. One example is to draw pool elements in a random fashion and then match each pool element to an outstanding ticket, the tickets taken in the order in which the tickets were purchased. Any method assuring an element of randomness in the association of a pool element and a wager (outstanding raffle ticket) may be used. After each ticket has been associated with a pool element, box 522 is left for box 516.

Box 524 shows an additional alternative method for running games in accordance with the present invention, in this case the pools may be constructed with either zero-elements (elements having no value, or a "loss" element) and win-elements, or with only with win-elements. This box corresponds to a method where each pool has a relatively small number of pool elements (can be as few as a single element, if the pool has only win-elements; or, as few as two elements if the pool has both zero-elements and win-elements). If the pool has both zero and win elements, then the system sells tickets (accepts wagers) equal to the number of pool elements, closes the game (ends this game), then randomly matches each ticket to a pool element; at that point box 524 would be left for box 516. If the pool contains only win-elements, then the system accepts a specified number of ticket requests (wagers) which will always be equal to or greater than the number of pool elements, and then randomly associates each pool element with a subset of the tickets sold. After associating the pool elements with tickets, box 524 is left for 516.

The advantage of small, fixed pools is that complete raffles, in the traditional sense, can be made to run very quickly. For example, if each pool has one win-element and each raffle is limited to two ticket sales (two wagers), and the server randomly associates the single pool element with one of the two tickets sold for that raffle, then raffle games may be made to turn over (result in a win or loss) very quickly in a casino environment. Clearly a plurality of pools would be kept available at multiple betting levels (the pool elements will have values calculated to give a certain return to players based on the value of their bets).

The actions corresponding to box 516 are to distribute the results for each ticket in the sold ticket pool back to the player terminal from which the ticket was bought (were the wager was made). The messages sent to the player terminals by the raffle server will include a ticket identifier and an associated prize, including a "no win" amount for tickets not drawn to be winners (alternatively, matched up with a no-value pool element). For winning tickets, an indicia of the prize will be sent (alternatively, for all tickets an indicia of the prize will be sent, including a "no-win" prize or pool element). This indicia may include a prize description (be a complete prize description), which would typically include no-win pool element (if applicable), game play credits, or monetary value wins; alternatively it may include a database key used to access more details about larger or more complex prizes from a database on the raffle server. Box 516 is left for box 518.

The actions corresponding to box 518 are those associated with display of the results of the game session to a player. Some actions are taken by the player terminal automatically, and some actions are instigated by player choice. In one preferred embodiment, the prizes that are drawn for each game session will be displayed on each player terminal where a ticket for that session was purchased. Additionally, a display showing the prize won at the player station can be shown. At the player's choice (or, if required by a local jurisdiction, done automatically), the player may be issued a voucher with prize winnings identified on it (alternatively, having machine readable indicia thereon used to look up the prize on a database). If the player wishes, the player may also choose to have an entertainment display.

An entertainment display is a display on the player terminal that in some fashion animates or actively displays the win results which have been sent to the player terminal by the raffle server. There are several possible preferred embodiments; which one is used will depend on the gaming establishment and the requirements of the local jurisdiction. There are a virtually unlimited number of entertainment displays that may be used, as will be apparent to a person of ordinary skill in this art and with the benefit of the present disclosure. For illustrative purposes, the entertainment display will be assumed to mimic the reel displays of a traditional Nevada-style slot machine.

One embodiment will have the player indicate they want to see an entertainment display after the winning prizes have been shown on the screen. The entertainment display would, using the data in the messages from the raffle server, map the winning results into a reel display that will have the corresponding win (including 0 wins, or no-wins).

In another preferred embodiment, the entertainment display is a portion of the overall display, enabling a portion of the display to show game results that are not part of the entertainment display. In this embodiment, the entertainment portion begins apparent visual movement as soon as a wager is made (in the example being used of reels, the reels will appear to start spinning). As soon as the game session completes, the non-entertainment portion of the screen will show the prizes that have been won, may optionally show if this particular player terminal has won one of the prizes, while simultaneously displaying stopped reels that show symbols corresponding to the prize that has already been won by the player terminal wager. Further, this embodiment provides the player with a choice of receiving a printed voucher having the outcome of the game session on it. If the player chooses to receive a voucher (alternatively, if a voucher is automatically printed because of jurisdictional requirements), then the player will have to re-insert the voucher into a player terminal to make use of any game credits that have been won. The player may always take the vouchers to a cashier's station as well.

Box 520 is entered next. The choice being made here is to check on the status of the prize pool. If it is empty or determined to be near enough to empty that it is likely that another session will overdraw the pool, then the "YES" exit is taken to Box 500. The process repeats, starting with the generation of a new prize pool. If the prize pool is not zero and can be used to play another session, then the "NO" exit is taken to box 502, where a new game session begins. Note: other open pool arrangements will readily come to mind of a person having skill in this art and having the benefit of the present disclosure. For example, it may be best to have two open pools, the second being opened and in use concurrently with the first, and where for reach game session prizes (pool elements) are selected from each pool in a manner exhausting each pool simultaneously, such as round-robin. Further, if game play is proceeding quickly, if may be best to have three or more open pools, each new pool being opened as the immediately prior pool dips below a certain percentage of remaining elements.

As is usually the case with flow diagrams, it can readily be seen that the represented methods includes "implied short cuts"; for example, if it is determined that the number of winners in box 508 is 0, then the process would, in actuality, proceed immediately to box 516.

Figure 6:
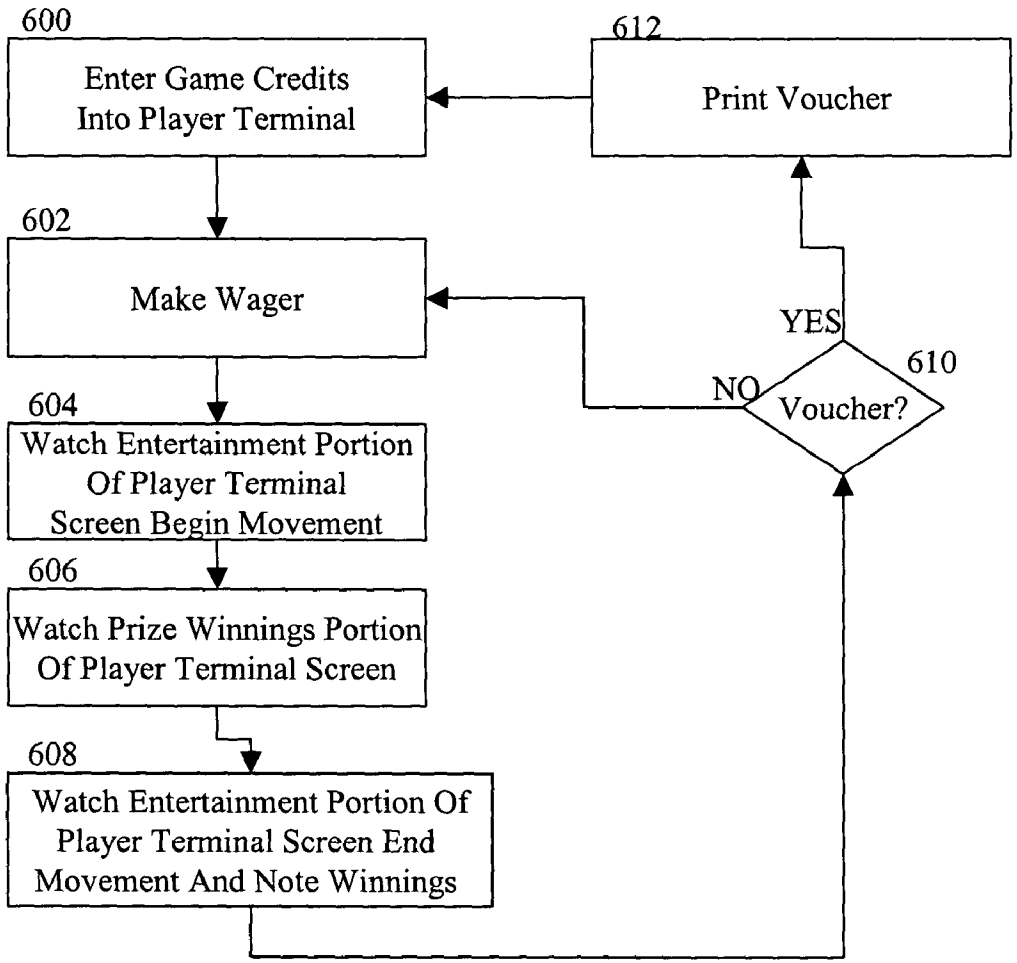
FIG. 6 is a flow diagram of raffle game played by a player according to the present invention.

FIG. 6 shows an example game session play from a player's perspective, using the present invention. In this example, the sessions last from one to a few seconds (as determined by the gaming establishment). Starting at box 600, the player enters game credits into a player terminal. The way in which the player enters the credits includes but is not limited to the insertion of cash, vouchers having credits on them, or player IDs that enable the use of EFT. Continuing with box 602, the player makes a wager, which includes but is not limited to choosing a wager amount, choosing an active game, touching a "re-bet" button which duplicates the last bet made, or any combination that results in identifying the game and the wager amount to be played (bet, wagered).

Continuing with box 604, as soon as the wager is made, the entertainment portion of the screen begins movement. This may take any form including dice, sports game action figures, etc. Continuing with the example used above, the display will show reels spinning. Moving to box 606, the player has the option of watching the non-entertaining portion of the screen, which includes a display showing the prizes that have been won for this session, and (optionally) show if this player terminal has won a prize. Continuing on to box 608, the player watches the entertainment portion of the screen until motion stops (using the reel example, until the spinning reels stop and show, using highlight lines, any reel combinations corresponding to the prize won and shown on the non-entertainment portion).

Continuing to decision diamond 610, the player chooses if they want a voucher or not (some jurisdictions will require a voucher to be printed). If they do not want a voucher, the "NO" exit is taken to box 602, where the player makes another wager. If the player wants a voucher, the "YES" exit is taken to box 612. The actions corresponding to box 612 are those involved with printing and then dispensing a voucher to the player. The player then continues play with box 600.

Although the description above contains many specificities, these should not be construed as limiting the scope of the invention to those specific details; these are exemplars of the presently preferred embodiment of the invention. The scope of this invention is determined by the claims and their legal equivalents.

What is claimed is:

1. In an automated raffle game system including a central raffle server and at least one player terminal, a method of providing automated raffle game sessions on the at least one player terminal, the method comprising:

creating at the central raffle server a prize pool comprising at least one prize and a win frequency;

selling at the at least one player terminal a group of electronic tickets during a game session as sold tickets, each sold ticket being associated with the game session and the prize pool;

determining a number of sold tickets that are declared as winners based on the number of sold tickets and the win frequency;

randomly drawing from among the sold tickets the number of tickets declared as winners as winning tickets;

randomly drawing a number of prizes from the prize pool equal to the number of winning tickets;

assigning a drawn prize to a winning ticket;

distributing to the at least one player terminal the results of the selling of the group of electronic tickets;

displaying the results of the selling of the group of electronic tickets at the at least one player terminal;

repeating game sessions until the prize pool is exhausted.

2. The method of claim 1 wherein displaying the results at the at least one player terminal comprises simulating the operation of a Nevada-style gaming machine.

3. The method of claim 2 wherein the Nevada-style gaming machine is at least one of: (a) a slot-style game, (b) a poker-style game, (c) a blackjack game, (d) a keno game, and (e) a bingo game.

4. The method of claim 1 wherein assigning a drawn prize to a winning ticket comprises sequentially assigning a drawn prize to a winning ticket.

5. The method of claim 1 wherein assigning a drawn prize to a winning ticket comprises randomly assigning a drawn prize to a winning ticket.

6. The method of claim 1 wherein in the prize pool a relatively higher win frequency is accompanied with relatively smaller individual prize values.

7. The method of claim 1 wherein the prize pool further comprises at least one target wager amount, and creating a prize pool comprises creating at least one prize pool for each target wager amount.

8. The method of claim 7 wherein selling a group of electronic tickets comprises associating an electronic ticket with a game session and one of the at least one prize pools.

9. The method of claim 1 wherein the duration of the game session is based on a fixed time period and the number of tickets sold during that time period.

10. The method of claim 1 wherein the win frequency is numerically manifest over a series of game sessions.

* * * * *